United States Patent [19]

Flierl et al.

[11] Patent Number: 4,473,808

[45] Date of Patent: Sep. 25, 1984

[54] ELECTROMAGNET SYSTEM FOR ELECTROMAGNETIC SWITCHGEAR

[75] Inventors: Erwin Flierl, Kummersbruck; Werner Harbauer, Schwandorf; Siegfried Held, Haselmuhl, all of Fed. Rep. of Germany

[73] Assignee: Siemens Aktiengesellschaft, Munich, Fed. Rep. of Germany

[21] Appl. No.: 428,952

[22] Filed: Sep. 30, 1982

[30] Foreign Application Priority Data

Nov. 25, 1981 [DE] Fed. Rep. of Germany ..... 3146714

[51] Int. Cl.[3] ..... H01F 7/10

[52] U.S. Cl. ..... 335/245; 335/281

[58] Field of Search ..... 335/243, 245, 244, 276, 335/281

[56] References Cited

U.S. PATENT DOCUMENTS 2,162,465 6/1939 Guilder ..... 335/245

2,735,967 2/1956 Lewus ..... 335/245

FOREIGN PATENT DOCUMENTS 1270655 9/1963 Fed. Rep. of Germany .

1901736 8/1964 Fed. Rep. of Germany .

554040 6/1943 United Kingdom .

*Primary Examiner*—George Harris

*Attorney, Agent, or Firm*—Kenyon & Kenyon

[57] ABSTRACT

An electromagnet system for electromagnetic switchgear, the system having movable and stationary magnet portions, the stationary magnet portion having a pole surface wherein slots are provided for inserting a short-circuit ring. The slots are arranged so that the short-circuit ring may be substituted with a pole plate which extends beyond the pole surface on all sides. The pole plate has an opening which corresponds to the size of the pole surface. The opening is provided with two straps thereacross which can be inserted into the slots. This arrangement permits operation of the electromagnet system in response to AC, as well as DC, excitation.

4 Claims, 3 Drawing Figures

ELECTROMAGNET SYSTEM FOR ELECTROMAGNETIC SWITCHGEAR

BACKGROUND OF THE INVENTION

This invention relates generally to electromagnetic switchgear, and more particularly, to an electromagnet system for such switchgear, the electromagnet system having movable and stationary magnet portions wherein slots are provided at the pole surfaces for inserting metal parts which influence the magnetic flux.

German Pat. No. 1,270,655 describes an electromagnet system for electromagnetic switchgear wherein slots are provided at the pole surfaces of movable and stationary magnet portions for inserting metal parts which affect the magnetic flux. In the known system, a contactor has a plunger-type magnet system in a cup-shaped magnetic return yoke. A metal part which influences the magnetic flux, illustratively a short-circuit ring, is fastened at a plate which guides the lines of force and which rests against the cup-shaped magnetic return portion. This short-circuit ring causes a shift of the flux so that the switchgear is rendered usable for AC excitation.

A further known switching arrangement, particularly of the type having hinged-armature contactors is adapted for DC operation in accordance with German Petty Pat. No. 1,901,736. In this known system, a pole plate is bolted to the pole core which extends through the exciter coil of the angular magnet yoke. The pole plate increases the area of the pole core and cooperates with the hinged armature.

SUMMARY OF THE INVENTION

In accordance with the invention, an electromagnet system for electromagnetic switchgear is provided which can be adapted for AC, excitation, as well as DC, excitation, using identical parts as much as possible. In such an electromagnet system, such a maximum utilization of parts is achieved in a simple manner by providing the slots on the pole surfaces at a place thereon which is suitable for inserting at least one pole plate which extends beyond the area of the pole on all sides. The pole plate is provided with a cutout having a size which corresponds to the cross-section of the pole and which is interrupted by two straps which fit the slots and which can be inserted into the pole. Thus, it is only necessary to replace the short-circuit ring by the pole plate without having to provide separate fastening devices for this purpose. In order that the movable magnet part be used with high efficiency for both, AC and DC excitation, the movable magnet part advantageously consists of several stacked metal plates which, in the pulled-up condition of the movable magnet part, are arranged parallel to the pole surface. Such an electromagnet system has been found to be practical, particularly as a hinged-armature magnet system, because of the advantageous noise behavior, and because the moving masses are small. In addition, this arrangement can be installed in almost any position, and is relatively insensitive to shock. Moreover, the switchgear is easily installed and provides a long mechanical surface life in view of the relatively small number of parts.

BRIEF DESCRIPTION OF THE DRAWINGS

Comprehension of the invention is facilitated by reading the following detailed description in conjunction with the annexed drawings, in which.

DETAILED DESCRIPTION

Figure 1:
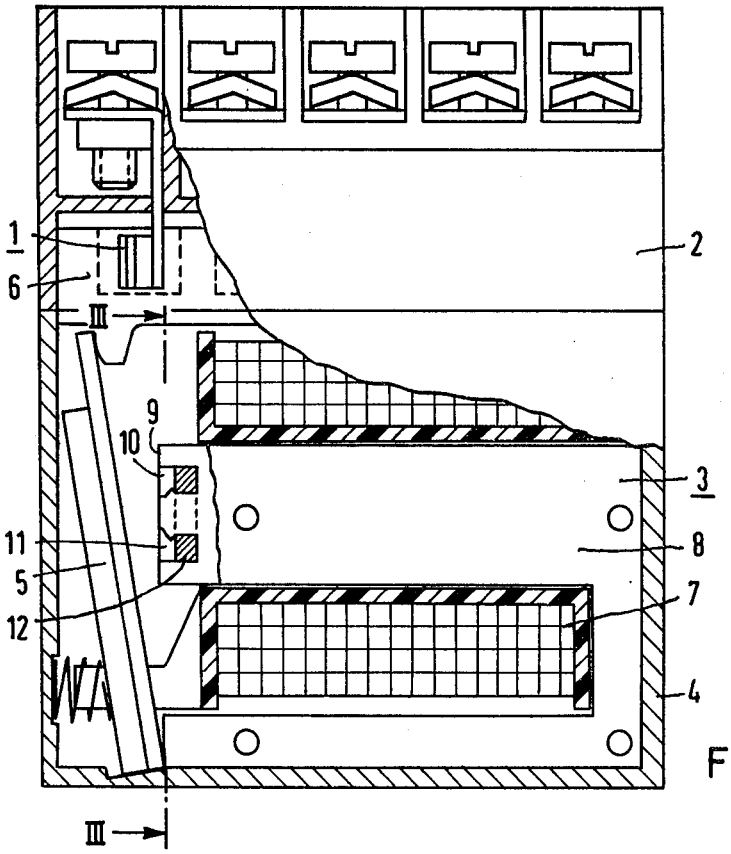
FIG. 1 is a partially fragmented illustration of a basic design of an electromagnetic switchgear having a hinged-armature magnet system and a short-circuit ring.

FIG. 1 shows an electromagnetic switchgear apparatus having a contact system 1 which is accommodated in an upper portion 2 of a housing. A hinged-armature magnet system 3 is arranged in a lower portion 4 of the housing. A movable magnet 5, also called an armature, which is composed of individual plates, actuates the contact bridge carrier 6 of contact system 1 in order to establish electrical contact in the usual manner by the application of a potential to a coil 7 of the magnet system. Such electrical contact is established in response to a pull resulting from the magnetic flux which is generated in a yoke 8.

Two slots, 10 and 11, are provided in a pole surface 9 of yoke 8; yoke 8 being arranged to pass through coil 7. A short-circuit ring 12 is inserted, in this embodiment, so that the hinged-armature system can operate as an AC-excited magnet system.

Figure 2:
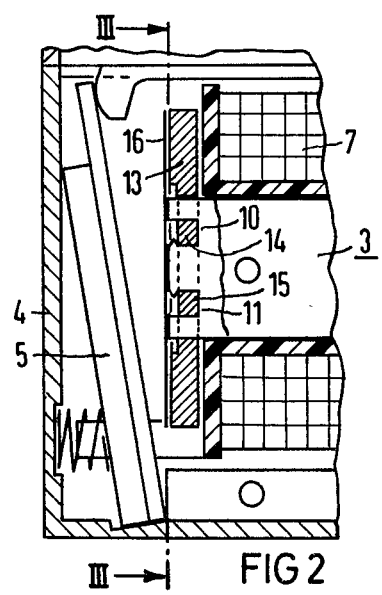
FIG. 2 shows the arrangement of FIG. 1 with a pole plate which is held at the pole surface, instead of a short-circuit ring.

FIG. 2 shows a pole plate 13 which is inserted into slots 10 and 11 with straps 14 and 15, instead of the short-circuit ring 12. Pole plate 13 is fastened, for example, in the same manner as the short-circuit rings. In this manner, the magnet system can, with suitable design of the pole plate, be used without further modification as a DC-excited magnet system. In this embodiment, pole plate 13 cooperates with movable magnet portion 5, which consists of stacked metal plates. When the movable magnet plate is pulled up, the direction of the metal plates is parallel to the longitudinal direction of pole plate 13. The use of stacked metal plates provides the advantage that, in AC operation, the power loss is relatively small. Moreover, one of the laminations can be used as the transmission element to the contact bridge carrier 6. A thin, anti-sticking foil 16 can be inserted between pole plate 13 and movable magnet 5, if required.

Figure 3:
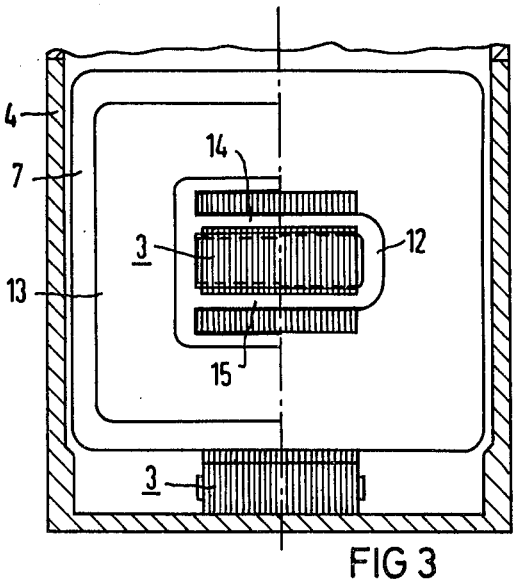
FIG. 3 is a cross-sectional view of the arrangement of FIG. 1 being viewed across the line III—III, wherein the arrangement of the pole plate is shown in the left half of the drawing, and the short-circuit ring installation is in the right half.

FIG. 3 is a cross-sectional representation of the embodiments of FIGS. 1 and 2, taken along line III—III. The left half of FIG. 3 shows the arrangement of the pole plate. The right half of the figure shows the installation of short-circuit ring 12.

Although the invention has been described in terms of specific embodiments and applications, persons skilled in the art, in light of this teaching, can generate additional embodiments without departing from the spirit, or exceeding the scope, of the claimed invention. Acordingly, the drawings and descriptions in this disclosure are proffered to facilitate comprehension of the invention and should not be construed to limit the scope thereof.

What is claimed is:

1. An electromagnet system for electromagnetic switchgear of the type having movable and stationary magnet portions, the stationary magnet portion having a pole surface with slots provided therein, the electromagnet system further comprising:

pole plate means having an opening therein, said opening having dimensions which correspond to the dimensions of the pole surface of the stationary magnet portion; and first and second straps extending across said opening in said pole plate means, said straps being configured to be accommodated in the slots in the pole surface of the stationary magnet portion so that said pole plate means extends beyond all sides of the pole surface.

2. The electromagnet system of claim 1 wherein the movable magnet portion comprises a plurality of stacked metal plates which are arranged to be parallel to the pole surface of the stationary magnet portion when the electromagnet system is in an energized state.

3. The electromagnet system of claim 1 or 2, wherein the electromagnet system is of a hinged-armature type.

4. An electromagnet system adapted for AC or DC excitation for electromagnetic switchgear of the type having movable and stationary magnet portions, the stationary magnet portion having a pole surface with at least one slot provided therein, the electromagnet system further comprising:

pole plate means having an opening therein, said opening having dimensions which correspond to the dimensions of the pole surface of the stationary magnet portion; and at least one strap extending across said opening in said pole plate means, said at least one strap being configured to be and being accomodated in said at least one slot in the pole surface of the stationary magnet portion to secure the pole plate means to the stationary magnet portion for DC excitation of the system, said at least one slot being adapted to hold a short-circuit ring in place of said at least one strap for AC excitation of the system.

* * * * *